US012378649B2

(12) United States Patent
Yuan et al.

(10) Patent No.: US 12,378,649 B2
(45) Date of Patent: Aug. 5, 2025

(54) METHOD FOR PRODUCING HYPEREUTECTOID STEEL RAIL RESISTANT TO CONTACT FATIGUE

(71) Applicant: PANGANG GROUP PANZHIHUA IRON & STEEL RESEARCH INSTITUTE CO., LTD., Panzhihua (CN)

(72) Inventors: Jun Yuan, Panzhihua (CN); Ming Zou, Panzhihua (CN); Yong Deng, Panzhihua (CN); Dawei Yang, Panzhihua (CN)

(73) Assignee: PANGANG GROUP PANZHIHUA IRON & STEEL RESEARCH INSTITUTE CO., LTD., Sichuan (CN)

( * ) Notice: Subject to any disclaimer, the term of this patent is extended or adjusted under 35 U.S.C. 154(b) by 0 days.

(21) Appl. No.: 17/919,897

(22) PCT Filed: Jun. 30, 2022

(86) PCT No.: PCT/CN2022/102695

§ 371 (c)(1),
(2) Date: Oct. 19, 2022

(87) PCT Pub. No.: WO2023/082661

PCT Pub. Date: May 19, 2023

(65) Prior Publication Data

US 2024/0279784 A1 Aug. 22, 2024

(30) Foreign Application Priority Data

Nov. 15, 2021 (CN) ..... 202111346816.6

(51) Int. Cl.

| | |
|---|---|
| ***C22C 38/24*** | (2006.01) |
| ***C21C 7/00*** | (2006.01) |
| ***C21C 7/076*** | (2006.01) |
| ***C21C 7/10*** | (2006.01) |
| ***C21D 9/04*** | (2006.01) |
| ***C22C 38/00*** | (2006.01) |

(52) U.S. Cl.

CPC ..... *C22C 38/24* (2013.01); *C21C 7/0056* (2013.01); *C21C 7/0075* (2013.01); *C21C 7/076* (2013.01); *C21C 7/10* (2013.01); *C21D 9/04* (2013.01); *C22C 38/001* (2013.01)

(58) Field of Classification Search

CPC ..... C22C 38/24; C22C 38/001; C22C 38/02; C22C 38/04; C22C 38/18; C22C 33/04; C21C 7/0056; C21C 7/0075; C21C 7/076; C21C 7/10; C21C 7/064; C21C 7/0006; C21C 7/072; C21D 9/04; C21D 1/19; C21D 1/60; C21D 8/005; B21B 1/085; B22D 11/009

USPC ..... 420/104

See application file for complete search history.

(56) References Cited

FOREIGN PATENT DOCUMENTS

| | | | | |
|---|---|---|---|---|
| CN | 107227429 A | * | 10/2017 | ..... C21C 1/02 |
| CN | 107739983 A | * | 2/2018 | |
| CN | 112481545 A | * | 3/2021 | |

OTHER PUBLICATIONS

CN107227429A Translation (Year: 2017).*
CN107739983A Translation (Year: 2018).*
CN112481545A Translation (Year: 2021).*

* cited by examiner

*Primary Examiner* — Danielle M. Carda

(57) ABSTRACT

The present invention discloses a method for producing a hypereutectoid steel rail resistant to contact fatigue. The method includes performing molten iron desulphurization, converter smelting, LF refining, RH refining, continuous casting and billet heating, rolling and heat treatment after rolling to obtain a steel rail; the heat treatment after rolling includes performing accelerated cooling and air cooling on the center of a tread of a rail head, both sides of the rail head and the center of a rail bottom of the steel rail obtained after rolling, wherein the starting cooling temperature of the accelerated cooling is 650-900° C., the cooling rate is 1.0-5.0° C./s, and the final cooling temperature is 400-550° C.; and after reaching the final cooling temperature, the accelerated cooling is stopped and it is air-cooled to room temperature. The hypereutectoid steel rail has higher purity, better contact fatigue resistance and good wear resistance.

11 Claims, No Drawings

METHOD FOR PRODUCING HYPEREUTECTOID STEEL RAIL RESISTANT TO CONTACT FATIGUE

TECHNICAL FIELD

The present invention belong to the technical field of steel rail production, particularly relates to a method for producing a hypereutectoid steel rail resistant to contact fatigue, and more particularly to a method for producing a hypereutectoid steel rail for heavy-duty railways with high wear resistance and contact fatigue damage resistance, which has high strength and toughness.

BACKGROUND ART

With the increase of heavy-duty railway traffic volume and the formation density, and the axle load of train increased gradually at home and abroad, the requirements for rail strength, toughness, wear resistance and contact fatigue resistance become higher and higher.

At present, the hypereutectoid steel rails with hardness above 400 HB are applied in most heavy-duty railways in the world, and the strength and wear resistance thereof basically meet the requirements of line use. However, it is necessary to perform grinding regularly to eliminate the chippings and prevent the rail damage from extending and developing. In order to improve the contact fatigue resistance of steel rails, the smelting process with high purity and low inclusion, i.e. low P, low S, low O, low N, low H and low non-metallic inclusions, is commonly used in the field of steel rails.

In order to improve the purity of steel rails, the external refining process is widely used, which has become an indispensable important part in the modern steelmaking process. The external refining technology has become the trend of iron and steel metallurgy in the world. The external refining refers to the process of smelting in the ladle, which combines the technologies of vacuum treatment, argon stirring, heating and temperature control, feeding line and powder injection, and micro alloying, in different forms, removing oxidation slags as much as possible before tapping, re-producing reducing slags in the ladle, and maintaining the reducing atmosphere in the ladle. The purpose of external refining is to reduce the content of C, P, S, O, H, N and other elements in the steel, so as to avoid segregation, white spots and large particle inclusions, which will reduce the tensile strength, toughness, fatigue strength, crack resistance, etc. of the steel.

The refining process plays an important role in the whole process. On the one hand, through this process, the purity of steel can be improved, harmful inclusions can be removed, micro alloying and inclusion modification can be performed. on the other hand, the refining is a buffer step, which is beneficial to evenly operate the continuous casting production.

Its characteristics and functions are as follows.

1) Metallurgical reaction conditions may be varied. The reaction products from deoxidation, decarburization and degassing in steelmaking are gas. The refining can be carried out under vacuum conditions, facilitating the forward reaction. The working pressure is usually ≥50 Pa, suitable for degassing the molten steel.
2) The mass transfer rate of the molten bath can be increased. The liquid-phase mass transfer rate determines the speed of metallurgical reaction. A variety of stirring forms (gas stirring, electromagnetic stirring, mechanical stirring) are used in the refining process to make the melt flow in the system, accelerate the process of heat and mass transfer in the melt, and achieve the purpose of uniform mixing.
3) The area of the slag steel reaction can be increased. There are stirring devices in all kinds of refining equipment. In the stirring process, the steel slag can be emulsified, the alloy and the steel slag can be melted, fused and polymerized in the process of floating with bubbles.
4) It can play a buffering role between the electric furnace (converter) and the continuous casting. The refining furnace has the flexibility to coordinate the operation time and temperature control and form a more smooth production process with continuous casting.

However, the hypereutectoid steel rail prepared by the existing technology is prone to contact fatigue and chipping, which seriously affects the operating efficiency and safety of the line.

Based on the above, it is necessary to develop a method for producing a hypereutectoid steel rail for heavy-duty railways with high wear resistance and contact fatigue damage resistance, which has high strength and toughness.

SUMMARY OF THE INVENTION

It is an object of the present invention to improve a method for resisting contact fatigue and chipping of a hypereutectoid steel rail to improve the toughness and plasticity of the steel rail while enhancing the strength of the hypereutectoid steel rail.

Based on this, it is necessary to adopt the following technical solutions in view of the above-mentioned technical problems.

The present invention provides a method for producing a hypereutectoid steel rail resistant to contact fatigue. The method includes performing molten iron desulphurization, converter smelting, LF refining, RH refining, continuous casting and billet heating, rolling and heat treatment after rolling to obtain a steel rail;

the heat treatment after rolling comprises performing accelerated cooling and air cooling on the center of a tread of a rail head, both sides of the rail head and the center of a rail bottom of the steel rail obtained after rolling, wherein the starting cooling temperature of the accelerated cooling is 650-900° C., the cooling rate is 1.0-5.0° C./s, and the final cooling temperature is 400-550° C.; and after reaching the final cooling temperature, the accelerated cooling is stopped and it is air-cooled to o room temperature;

wherein the chemical composition of the steel rail comprises 0.9 mass %-1.2 mass % of C, based on the total mass of the steel rail.

Further, the chemical composition of the steel rail further comprises, based on the total mass of the steel rail:

0.5 mass %≤Si+Mn+P+S+Cr≤3.5 mass %, 0.01 mass %-0.12 mass % of V, and the balance being Fe and inevitable impurities.

Further, the steel rail has a P content of ≤0.015 mass %. Further, the steel rail has a P content of ≤0.008 mass %.

Further, the gas content of the steel rail comprises a hydrogen content of ≤0.00012 mass %, an oxygen content of ≤0.0008 mass %, and a nitrogen content of ≤0.0035 mass %.

Further, a cooling medium for the accelerated cooling is compressed air and/or a water mist mixture, preferably a water mist mixture sprayed at an air pressure of 0.1-0.2 MPa cooperating with water having a volume of 200-350 L/h.

Further, the LF refining comprises slag top deoxidation with a slag charge including 10 mass %-30 mass % of silicon carbide, 5 mass %-20 mass % of fluorite, and 30 mass %-40 mass % of quartz sand.

Further, a thickness of the slag charge of the molten steel is controlled to be 30-100 mm.

Further, 5 mass % of slag charge is added for every 10 min.

Further, 10-30% of activated limestone, 5-25% of calcium carbide and 300-1500 m of calcium wire are added before the vacuum degassing treatment in the RH refining, and not added after vacuum degassing.

Further, the steel rail compression ratio during the rolling is ≥12.

Further, A type inclusions in the steel rail are ≤1.5.

Further, B type inclusions in the steel rail are ≤1.0.

Further, C type inclusions in the steel rail are ≤1.0.

Further, D type inclusions in the steel rail are ≤1.0.

Further, the properties of the steel rail are as follows:

$$C^{*}HBW/[(P+S)+(H+O+N)^{*}100] \geq 15000; \quad (1)$$

$$HBW/(A+B+C+D) \geq 200; \quad (2)$$

$$Rm^{*}A \geq 11000. \quad (3)$$

The present invention have the following advantageous effects.

The method of the present invention for producing a hypereutectoid steel rail resistant to contact fatigue produces a hypereutectoid steel rail having a tread hardness >420 HB, a laboratory steel rail wear of less than 0.2 g, and an increase in contact fatigue performance by 20%. The hypereutectoid steel rail has higher purity, better contact fatigue resistance and good wear resistance.

DETAILED DESCRIPTION OF THE INVENTION

In order that the objects, technical solutions, and advantages of the present invention will become more apparent, a more particular description of the invention will be rendered by reference to the embodiments.

The main process flow of external refining includes LF refining and RH refining.

LF refining (Steel ladle refining furnace method): it is heated with an electric arc and stirred with bottom blowing argon for the ladle.

Process advantages

1) Arc heating has high thermal efficiency, large heating range and temperature control accuracy of ±5° C.;
2) It has the functions of stirring and alloying, and it is easy to control the alloy composition in a narrow range and improve the stability of the product by the argon stirring;
3) It is suitable to produce ultra-low sulfur steel and ultra-low oxygen steel with less equipment investment and low refining cost.

Key points of LF refining production process

1) The heating and temperature control LF adopts arc heating, which has high thermal efficiency. The power consumption is 0.5-0.8 kW·h when the temperature of molten steel is increased by 1° C. The heating rate of LF depends on the specific power of power supply (kVA/t), which in turn depends on the melting loss index of ladle refractory. Due to the use of submerged arc foam slag technology, the heat radiation loss of the arc can be reduced, the thermal efficiency can be improved by 10%-15%, and the accuracy of the end temperature is ≤±5° C.
2) White slag refining process. The slag removal amount is controlled at ≤5 kg/t, and the slag package basicity R≥3 is generally used to avoid the re-oxidation of slags. It should avoid exposing molten steel while argon stirring.
3) Alloy fine-tuning and narrow compositional range control. It has been reported experimentally that the use of alloy core wire technology can improve metal recovery.

RH refining (vacuum circulation degassing method) has the basic principle to continuously lift the molten steel into a vacuum chamber using bubbles to degas, decarburize and then back flow to the ladle.

Advantages of RH Refining

1) Fast reaction. Vacuum degassing cycle is short, degassing operation can be completed in 10 minutes, and alloying and temperature homogenization can be completed in 5 minutes, which can be used in combination with converter.
2) High reaction efficiency. The molten steel is directly reacted in the vacuum chamber, and an ultra-pure steel of $[H] \leq 1.0 \times 10^{-6}$, $[N] \leq 25 \times 10^{-6}$, and $[C] \leq 10 \times 10^{-6}$ can be obtained from the steel.
3) Oxygen decarburization and secondary combustion heat compensation can be performed to reduce the temperature drop in the refining process.

Embodiments of the present invention provide a method for producing a hypereutectoid steel rail resistant to contact fatigue. The method includes performing molten iron desulphurization, converter smelting, LF refining, RH refining, continuous casting and billet heating, rolling and heat treatment after rolling to obtain a steel rail.

In the embodiment of the present invention, the smelting process of the rolled steel of the steel rail is not particularly limited and may be performed according to a conventional smelting method. For example, in the smelting process of the rolled steel of the steel rail, the content of S in the molten iron entering the furnace is relatively low and may be ≤0.015 wt %. The basicity of the refining slag is preferably 3-5, such as a mixture of aluminium trioxide, barium oxide and calcium fluoride. Preferably, the content of $Al_2O_3$ is from 20-25 wt %, the content of BaO is 8-12 wt %, and the content of $CaF_2$ is 3-8 wt %. A carburizer is used. The carburizer used is anthracite and a low-N alloy. A blowing agent is used during heating of the LF furnace. The continuous casting process of the steel rail after smelting to obtain molten steel is not particularly limited. For example, the continuous casting process of the steel rail may include that the molten steel obtained by smelting is cast into a billet, and the billet is slowly cooled to room temperature, then sent into a heating furnace for heating and heat preservation, and rolled.

The heat treatment after rolling includes performing accelerated cooling and air cooling on the center of a tread of a rail head, both sides of the rail head and the center of a rail bottom of the steel rail obtained after rolling, wherein the starting cooling temperature of the accelerated cooling is 650-900° C., the cooling rate is 1.0-5.0° C./s, and the final cooling temperature is 400-550° C.; and after reaching the final cooling temperature, the accelerated cooling is stopped and it is air-cooled to room temperature.

The chemical composition of the rail includes, based on the total mass of the steel rail, 0.9 mass %-1.2 mass % of C, 0.5 mass %≤Si+Mn+P+S+Cr≤3.5 mass %, 0.01 mass %-0.12 mass % of V, and the balance being Fe and inevitable impurities.

The P content in the steel rail is ≤0.015 mass %. Preferably, the P content in the steel rail is ≤0.008 mass %.

The steel rail also contains a gas with the gas content including a hydrogen content of ≤0.00012 mass %, an oxygen content of ≤0.0008 mass %, and a nitrogen content of ≤0.0035 mass %.

A cooling medium for the accelerated cooling is compressed air and/or a water mist mixture, preferably a water mist mixture sprayed at an air pressure of 0.1-0.2 MPa cooperating with water having a volume of 200-350 L/h.

The LF refining comprises slag top deoxidation with a slag charge including 10 mass %-30 mass % of silicon carbide, 5 mass %-20 mass % of fluorite, and 30 mass %-40 mass % of quartz sand.

The slag thickness of the molten steel is controlled to be 30-100 mm. 5 mass % of slag charge is added for every 10 min.

A10-30% of activated limestone, 5-25% of calcium carbide and 300-1500 m of calcium wire are added before the vacuum degassing treatment in the RH refining, and not added after vacuum degassing.

In the embodiment of the present invention, the LF refining and the RH refining of the rolled steel of the steel rail are not particularly limited except for the above conditions, and may be performed according to a conventional LF refining and a RH refining method.

The steel rail compression ratio during the rolling is ≥12.

A type inclusions in the steel rail are ≤1.5; B type inclusions in the steel rail are ≤1.0; C type inclusions in the steel rail are ≤1.0; and D type inclusions in the steel rail are ≤1.0.

The properties of the steel rail are as follows:

$$C^{*}HBW/[(P+S)+(H+O+N)^{*}100] \geq 15000; \quad (1)$$

$$HBW/(A+B+C+D) \geq 200; \quad (2)$$

$$Rm^{*}A \geq 11000. \quad (3)$$

The present invention relates to a method for producing a hypereutectoid steel rail resistant to contact fatigue by using a low-S molten iron into the furnace and a high-basicity refining slag for a steel rail in a smelting process, and full-course protective casting. Anthracite and low-N alloys are used for the carburizer. The LF and RH processes reduce the content of C, P, S, O, H, N and other elements in the steel. LF molten steel slags in the process contain 10%-30% of silicon carbide, 5-20% of fluorite and 30-40% of quartz sand. 10-30% of activated limestone, 5-25% of calcium carbide and 300-1500 m of calcium wire are additionally added before the vacuum treatment, and not added after the vacuum treatment. The thickness of molten steel slag charge is controlled at 30-100 mm, and 5% of mixed slag charge is additionally added per 10 min. The LF and RH processes reduce the content of C, P, S, O, H, N and other elements in the steel. A certain cooling medium is applied at the central part of the rail bottom within the range of 900° C.-650° C. The cooling rate of the rail head tread, the rail head and the rail bottom center is 1.0-5.0° C./s. When the temperature of the rail head tread drops to 400-550° C., the accelerated cooling is stopped and it is air-cooled to room temperature. The hypereutectoid steel rail manufactured by this method has a tread hardness >420 HB, a laboratory steel rail wear of less than 0.2 g, and an increase in contact fatigue performance by 20%. The hypereutectoid steel rail has higher purity, better contact fatigue resistance and good wear resistance. As a result, the strength of hypereutectoid steel rail is greatly improved while the strength of hypereutectoid steel rail is increased. Finally, the steel rail produced has improved contact fatigue resistance.

Hereinafter, a method for producing a high-strength high-toughness hypereutectoid according to the present invention will be specifically described with reference to embodiments. The following nine sets of steel rail chemistries are chosen for both the embodiments and the corresponding comparative examples in the invention. Table 1 shows different contents of C, P, S, H, O, and N obtained by smelting process control.

TABLE 1

Chemical composition/mass % of Embodiments and Comparative examples

| | | Chemical elements/% | | | Gas contents/ppm | | |
|---|---|---|---|---|---|---|---|
| Items | No. | C | P | S | H | O | N |
| Embodiments | 1# | 0.90 | 0.004 | 0.002 | 0.6 | 4 | 31 |
| | 2# | 0.94 | 0.005 | 0.002 | 0.6 | 5 | 32 |
| | 3# | 0.96 | 0.006 | 0.003 | 0.7 | 5 | 30 |
| | 4# | 0.98 | 0.007 | 0.003 | 0.6 | 6 | 30 |
| | 5# | 1.02 | 0.008 | 0.004 | 0.7 | 5 | 31 |
| | 6# | 1.06 | 0.009 | 0.004 | 0.8 | 5 | 32 |
| | 7# | 1.08 | 0.010 | 0.005 | 0.7 | 6 | 31 |
| | 8# | 1.12 | 0.012 | 0.005 | 0.7 | 7 | 30 |
| Comparative examples | 1# | 0.96 | 0.015 | 0.006 | 1.0 | 10 | 49 |
| | 2# | 0.98 | 0.016 | 0.007 | 1.1 | 11 | 51 |
| | 3# | 0.96 | 0.019 | 0.008 | 1.2 | 12 | 52 |
| | 4# | 0.98 | 0.016 | 0.012 | 1.1 | 11 | 53 |

The comparative example in the present invention uses the same smelting, heating and heat treatment process as those in the embodiments.

The tensile properties of the steel rail of Embodiments and Comparative examples are tested according to the standard requirements on both sides of the rail head, and the tread hardness samples are tested on a tread position of the rail head. The test results are shown in Table 2. Table 2 illustrates the variation values of the tensile strength Rm and the elongation ratio Ain the tensile properties of the finished steel rail at the contents of C, P, S, H, O and N described in Table 1, and the corresponding formula values. The larger the number of HBW is, the more wear resistant it is. The larger the value of C*HBW/[(P+S+H+O+N)], the better the fatigue resistance. Larger value of Rm*A indicates better wear resistance and fatigue resistance of the rail.

TABLE 2

Tensile properties and tread hardness of Embodiments and Comparative examples in the invention

| Items | No. | Chemical elements/ % C | P | S | Gas contents/ ppm H | O | N | HBW | Tensile properties Rm | A | C*HBW/[(P + S + H + O + N)] | Rm* A |
|---|---|---|---|---|---|---|---|---|---|---|---|---|
| Embodiments | 1# | 0.90 | 0.004 | 0.002 | 0.6 | 4 | 31 | 405 | 1438 | 11.5 | 38127.6 | 16537.0 |
| | 2# | 0.94 | 0.005 | 0.002 | 0.6 | 5 | 32 | 409 | 1445 | 11 | 35730.5 | 15895.0 |
| | 3# | 0.96 | 0.006 | 0.003 | 0.7 | 5 | 30 | 411 | 1469 | 10.5 | 31389.0 | 15424.5 |
| | 4# | 0.98 | 0.007 | 0.003 | 0.6 | 6 | 30 | 416 | 1481 | 10 | 29844.8 | 14810.0 |
| | 5# | 1.02 | 0.008 | 0.004 | 0.7 | 5 | 31 | 420 | 1510 | 9.5 | 27338.9 | 14345.0 |
| | 6# | 1.06 | 0.009 | 0.004 | 0.8 | 5 | 32 | 426 | 1532 | 9 | 26910.6 | 13788.0 |
| | 7# | 1.08 | 0.010 | 0.005 | 0.7 | 6 | 31 | 432 | 1539 | 8.5 | 24856.7 | 13081.5 |
| | 8# | 1.12 | 0.012 | 0.005 | 0.7 | 7 | 30 | 440 | 1551 | 8 | 23726.5 | 12408.0 |
| Comparative examples | 1# | 0.96 | 0.015 | 0.006 | 1.0 | 10 | 49 | 415 | 1451 | 7.0 | 14755.6 | 10157.0 |
| | 2# | 0.98 | 0.016 | 0.007 | 1.1 | 11 | 51 | 414 | 1452 | 7.5 | 13842.4 | 10890.0 |
| | 3# | 0.96 | 0.019 | 0.008 | 1.2 | 12 | 52 | 416 | 1453 | 7.5 | 11914.1 | 10897.5 |
| | 4# | 0.98 | 0.016 | 0.012 | 1.1 | 11 | 53 | 416 | 1455 | 7.5 | 11813.4 | 10912.5 |

According to the requirements of TB/T 2344-2012 "Ordering technical conditions for 43 kg/m-75 kg/m steel rails", it inspects the non-metallic inclusions at 10-15 mm under the rail head tread, and ranks them, as shown in Table 3. Table 3 illustrates the relationship between the sizes and classes of non-metallic inclusions present in the steel rail and the hardness HBW in a center line of the top surface of the finished steel rail at the contents of C, P, S, H, O and N described in Table 1.

TABLE 3

Nonmetallic inclusions of Embodiments and Comparative examples in the invention

| Items | No. | Chemical elements/ % C | P | S | Gas contents/ ppm H | O | N | HBW | Non-metallic inclusion Class A | Class B | Class C | Class D | HBW/(A + B + C + D) |
|---|---|---|---|---|---|---|---|---|---|---|---|---|---|
| Embodiments | 1# | 0.90 | 0.004 | 0.002 | 0.6 | 4 | 31 | 405 | 0.5 | 0 | 0 | 0 | 810.0 |
| | 2# | 0.94 | 0.005 | 0.002 | 0.6 | 5 | 32 | 409 | 0.5 | 0 | 0 | 0 | 818.0 |
| | 3# | 0.96 | 0.006 | 0.003 | 0.7 | 5 | 30 | 411 | 1.0 | 0 | 0 | 0 | 411.0 |
| | 4# | 0.98 | 0.007 | 0.003 | 0.6 | 6 | 30 | 416 | 0.5 | 0 | 0 | 0 | 832.0 |
| | 5# | 1.02 | 0.008 | 0.004 | 0.7 | 5 | 31 | 420 | 0.5 | 0 | 0.5 | 0 | 420.0 |
| | 6# | 1.06 | 0.009 | 0.004 | 0.8 | 5 | 32 | 426 | 1.0 | 0.5 | 0 | 0 | 284.0 |
| | 7# | 1.08 | 0.010 | 0.005 | 0.7 | 6 | 31 | 432 | 0.5 | 0 | 0.5 | 0.5 | 288.0 |
| | 8# | 1.12 | 0.012 | 0.005 | 0.7 | 7 | 30 | 440 | 0.5 | 0 | 0 | 0 | 880.0 |
| Comparative examples | 1# | 0.96 | 0.015 | 0.006 | 1.0 | 10 | 49 | 415 | 1.0 | 0.5 | 0.5 | 0.5 | 166.0 |
| | 2# | 0.98 | 0.016 | 0.007 | 1.1 | 11 | 51 | 414 | 1.5 | 0.5 | 1.0 | 0.5 | 118.3 |
| | 3# | 0.96 | 0.019 | 0.008 | 1.2 | 12 | 52 | 416 | 2.5 | 1.5 | 2 | 1.5 | 55.5 |
| | 4# | 0.98 | 0.016 | 0.012 | 1.1 | 11 | 53 | 416 | 2.5 | 2 | 2.5 | 2 | 46.2 |

Wear samples are taken at the rail heads of the embodiments and the comparative examples, respectively, and the test results are shown in Table 4.

Table 4 shows the hardness of a center line of a top surface of the steel rail vs. the wear amount of the finished steel rail at the contents of C, P, S, H, O and N described in Table 1. The wear amount is closely related to the hardness of steel rail. By increasing the carbon content of the steel rail and assisted by the heat treatment process, the hardness of the center line of the rail top surface is increased, and then the rail wear is reduced.

TABLE 4

Wear of the rail head of the steel rail in Embodiments and Comparative examples in the invention

| Items | No. | Chemical elements/ % C | P | S | Gas contents/ ppm H | O | N | HBW | Test parameters Load (N) | Revolutions (10,000 times) | Wear amount (g) |
|---|---|---|---|---|---|---|---|---|---|---|---|
| Embodiments | 1# | 0.90 | 0.004 | 0.002 | 0.6 | 4 | 31 | 405 | 980 | 10 | 0.22 |
| | 2# | 0.94 | 0.005 | 0.002 | 0.6 | 5 | 32 | 409 | 980 | 10 | 0.21 |
| | 3# | 0.96 | 0.006 | 0.003 | 0.7 | 5 | 30 | 411 | 980 | 10 | 0.20 |
| | 4# | 0.98 | 0.007 | 0.003 | 0.6 | 6 | 30 | 416 | 980 | 10 | 0.19 |
| | 5# | 1.02 | 0.008 | 0.004 | 0.7 | 5 | 31 | 420 | 980 | 10 | 0.18 |
| | 6# | 1.06 | 0.009 | 0.004 | 0.8 | 5 | 32 | 426 | 980 | 10 | 0.17 |
| | 7# | 1.08 | 0.010 | 0.005 | 0.7 | 6 | 31 | 432 | 980 | 10 | 0.16 |
| | 8# | 1.12 | 0.012 | 0.005 | 0.7 | 7 | 30 | 440 | 980 | 10 | 0.15 |
| Comparative examples | 1# | 0.96 | 0.015 | 0.006 | 1.0 | 10 | 49 | 415 | 980 | 10 | 0.20 |
| | 2# | 0.98 | 0.016 | 0.007 | 1.1 | 11 | 51 | 414 | 980 | 10 | 0.21 |
| | 3# | 0.96 | 0.019 | 0.008 | 1.2 | 12 | 52 | 416 | 980 | 10 | 0.20 |
| | 4# | 0.98 | 0.016 | 0.012 | 1.1 | 11 | 53 | 416 | 980 | 10 | 0.21 |

Contact fatigue samples are taken at the rail head of the embodiments and comparative Examples, respectively, and the test results are shown in Table 5.

Table 5 shows the relationship between rail contact fatigue performance, hardness and internal hardness at the contents of C, P, S, H, O and N as described in Table 1. The fatigue performance of the steel rail can be improved by reducing C, P, S, H, O and N.

TABLE 5

Rail contact fatigue in Embodiments and Comparative examples of the invention

| Items | No. | Chemical elements/ % C | P | S | Gas contents/ ppm H | O | N | HBW | Contact Stress/ MPa | Slip/ % | Rotational speed rpm | Contact fatigue/ 1,000 0 times |
|---|---|---|---|---|---|---|---|---|---|---|---|---|
| Embodiments | 1# | 0.90 | 0.004 | 0.002 | 0.6 | 4 | 31 | 405 | 1350 | 5 | 1000 | 40 |
| | 2# | 0.94 | 0.005 | 0.002 | 0.6 | 5 | 32 | 409 | 1350 | 5 | 1000 | 39 |
| | 3# | 0.96 | 0.006 | 0.003 | 0.7 | 5 | 30 | 411 | 1350 | 5 | 1000 | 38 |
| | 4# | 0.98 | 0.007 | 0.003 | 0.6 | 6 | 30 | 416 | 1350 | 5 | 1000 | 37 |
| | 5# | 1.02 | 0.008 | 0.004 | 0.7 | 5 | 31 | 420 | 1350 | 5 | 1000 | 37 |
| | 6# | 1.06 | 0.009 | 0.004 | 0.8 | 5 | 32 | 426 | 1350 | 5 | 1000 | 36 |
| | 7# | 1.08 | 0.010 | 0.005 | 0.7 | 6 | 31 | 432 | 1350 | 5 | 1000 | 36 |
| | 8# | 1.12 | 0.012 | 0.005 | 0.7 | 7 | 30 | 440 | 1350 | 5 | 1000 | 35 |
| Comparative examples | 1# | 0.96 | 0.015 | 0.006 | 1.0 | 10 | 49 | 415 | 1350 | 5 | 1000 | 21 |
| | 2# | 0.98 | 0.016 | 0.007 | 1.1 | 11 | 51 | 414 | 1350 | 5 | 1000 | 19 |
| | 3# | 0.96 | 0.019 | 0.008 | 1.2 | 12 | 52 | 416 | 1350 | 5 | 1000 | 18 |
| | 4# | 0.98 | 0.016 | 0.012 | 1.1 | 11 | 53 | 416 | 1350 | 5 | 1000 | 17 |

In view of the above, the method for producing a hypereutectoid steel rail according to the present invention provides an effective method for improving the contact fatigue resistance of the steel rail while improving the strength of the rail. The product is applicable to lines with heavy axle load, high density, and heavy load.

The foregoing is the exemplary embodiments of the present disclosure. It should be noted that various changes and modifications can be made herein without departing from the scope of the disclosed embodiments as defined by the appended claims. Although elements disclosed in the embodiments of the present invention can be described or required in individual forms, a plurality is contemplated unless explicitly limited to the singular.

Those of ordinary skill in the art will appreciate that the above discussion of any embodiments is intended to be exemplary only, and is not intended to suggest that the scope of the disclosed embodiments (including the claims) is limited to these examples. Combinations of features in the above embodiments or in different embodiments are also possible within the idea of embodiments of the invention, and many other variations of different aspects of the embodiments of the invention as described above are not provided in detail for the sake of clarity. Therefore, any omission, modification, equivalent substitution or improvement made within the spirit and principle of the embodiment of the invention shall be included in the scope of protection of the embodiment of the invention.

The invention claimed is:

1. A method for producing a hypereutectoid steel rail resistant to contact fatigue, characterized in that the method comprises performing molten iron desulphurization, converter smelting, LF refining, RH refining, continuous casting and billet heating, rolling and heat treatment after rolling to obtain a steel rail;

the heat treatment after rolling comprises performing accelerated cooling and air cooling on the center of a tread of a rail head, both sides of the rail head and the center of a rail bottom of the steel rail obtained after rolling, wherein the starting cooling temperature of the accelerated cooling is 650-900° C., the cooling rate is 1.0-5.0° C./s, and the final cooling temperature is 400-550° C.; and after reaching the final cooling temperature, the accelerated cooling is stopped and the steel rail is air-cooled to room temperature;

wherein the chemical composition of the steel rail comprises 0.9 mass %-1.2 mass % of C, based on the total mass of the steel rail;

wherein the RH refining comprises vacuum degassing, wherein, 10-30 mass % of activated limestone, 5-25 mass % of calcium carbide and 300-1500 m of calcium wire are added, based on the total amount of slag, before the vacuum degassing treatment in the RH refining, and not added after vacuum degassing.

2. The method for producing the hypereutectoid steel rail resistant to contact fatigue according to claim 1, characterized in that the chemical composition of the rail further comprises, based on the total mass of the steel rail, 0.5 mass % ≤Si+Mn+P+S+Cr≤3.5 mass %, 0.01 mass %- 0.12 mass % of V, and the balance being Fe and inevitable impurities.

3. The method for producing the hypereutectoid steel rail resistant to contact fatigue according to claim 2, characterized in that a cooling medium for the accelerated cooling is compressed air or a water mist mixture.

4. The method for producing the hypereutectoid steel rail resistant to contact fatigue according to claim 3, characterized in that the cooling medium for the accelerated cooling is the water mist mixture sprayed at an air pressure of 0.1-0.2 MPa cooperating with water having a volume of 200-350 L/h.

5. The method for producing the hypereutectoid steel rail resistant to contact fatigue according to claim 1, characterized in that the steel rail has a P content of ≤0.015 mass %.

6. The method for producing the hypereutectoid steel rail resistant to contact fatigue according to claim 1, characterized in that the gas content of the steel rail comprises a hydrogen content of ≤0.00012 mass %, an oxygen content of ≤0.0008 mass %, and a nitrogen content of ≤0.0035 mass %.

7. The method for producing the hypereutectoid steel rail resistant to contact fatigue according to claim 1, characterized in that a cooling medium for the accelerated cooling is compressed air and/or a water mist mixture.

8. The method for producing the hypereutectoid steel rail resistant to contact fatigue according to claim 1, characterized in that the LF refining comprises slag top deoxidation with a slag charge including 10 mass %-30 mass % of silicon carbide, 5 mass %- 20 mass % of fluorite, and 30 mass %-40 mass % of quartz sand.

9. The method for producing the hypereutectoid steel rail resistant to contact fatigue according to claim 8, characterized in that a thickness of the slag charge of the molten steel is controlled to be 30-100 mm.

10. The method for producing the hypereutectoid steel rail resistant to contact fatigue according to claim 9, characterized in that 5 mass % of slag charge is added for every 10 min.

11. The method for producing the hypereutectoid steel rail resistant to contact fatigue according to claim 1, characterized in that the steel rail compression ratio during the rolling is ≥12.

* * * * *